United States Patent [19]

Junghans et al.

[11] 4,428,290

[45] Jan. 31, 1984

[54] DEVICE FOR AXIALLY RECIPROCATING AN INKING-UNIT ROLLER OF A ROTARY PRINTING MACHINE

[75] Inventors: Rudi Junghans, Wilhelmsfeld; Hermann Beisel, Walldorf, both of Fed. Rep. of Germany

[73] Assignee: Heidelberger Druckmaschinen Aktiengesellschaft, Heidelberg, Fed. Rep. of Germany

[21] Appl. No.: 272,196

[22] Filed: Jun. 10, 1981

[30] Foreign Application Priority Data

Jun. 14, 1980 [DE] Fed. Rep. of Germany ... 8015906[U]

[51] Int. Cl.[3] ..... B41F 31/14; B41L 27/16

[52] U.S. Cl. ..... 101/348; 101/DIG. 14

[58] Field of Search ..... 101/348, 349, 205, 206, 101/207, 350, DIG. 14; 74/22 R, 22 A, 56, 57, 58, 60, 568 R, 568 FS; 308/176

[56] References Cited

U.S. PATENT DOCUMENTS

| | | | |
|---|---|---|---|
| 2,940,322 | 6/1960 | Uhing | 74/22 |
| 3,110,253 | 11/1963 | Du Bois | 101/348 |
| 3,348,480 | 10/1967 | Bohac et al. | 101/349 |
| 3,815,498 | 6/1974 | Harrod | 101/348 |
| 3,966,280 | 6/1976 | Olrik | 308/176 |
| 4,040,682 | 8/1977 | Poulsen | 74/57 X |

*Primary Examiner*—J. Reed Fisher

*Attorney, Agent, or Firm*—Herbert L. Lerner; Laurence A. Greenberg

[57] ABSTRACT

Device for axially reciprocating an inking-unit roller of a rotary printing machine having a fixed shaft and a frictionally driven roller shell including a pair of rings formed with opposing circular roller tracks disposed within the inking-unit roller and repectively secured to the shaft and the roller shell, one of the rings being skewed in axial direction with respect to the other of the rings, and a ball rollably received in both of the roller tracks and actuatable for effecting a step-down in speed of the axial reciprocatory motion of the inking-unit roller.

4 Claims, 2 Drawing Figures

Figure 1:
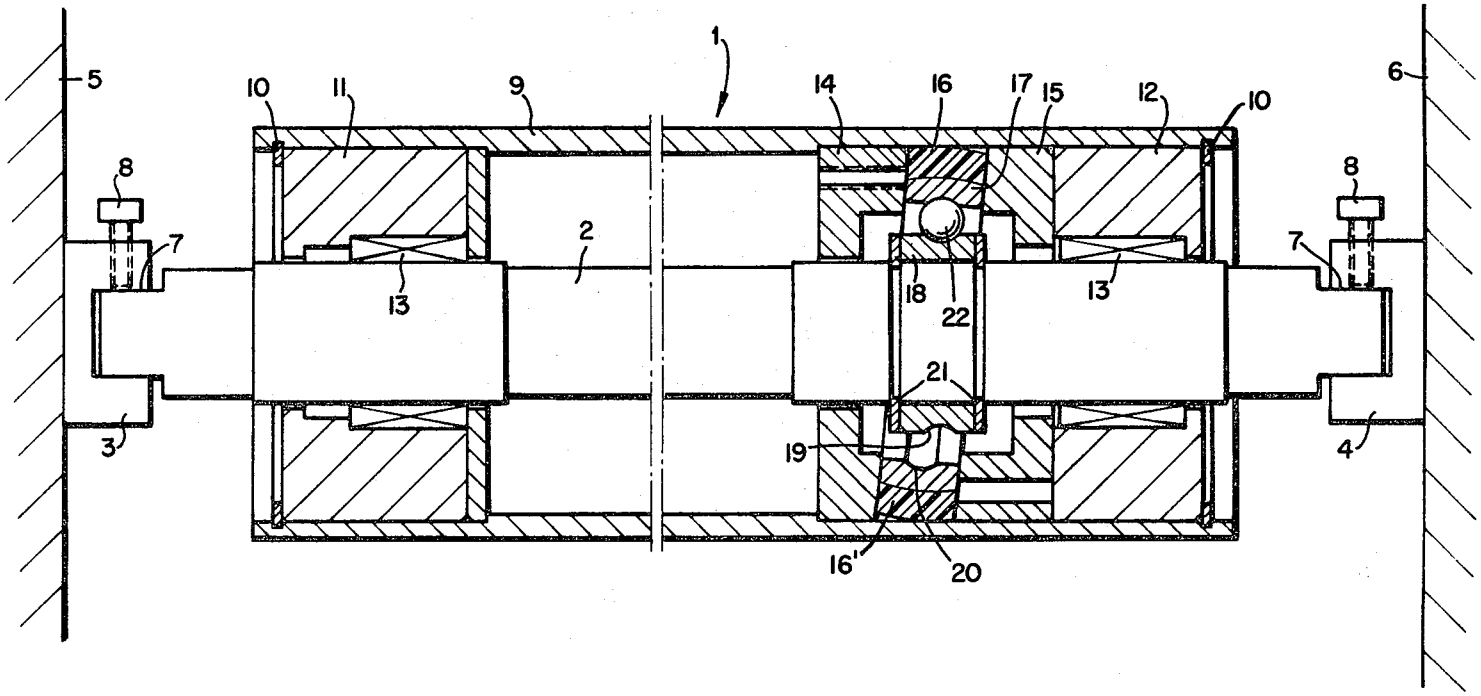

DEVICE FOR AXIALLY RECIPROCATING AN INKING-UNIT ROLLER OF A ROTARY PRINTING MACHINE

The invention relates to a device for axially reciprocating an inking-unit roller of a rotary printing machine and, more particularly, to such an inking-unit roller having a fixed shaft and a frictionally driven roller shell. A device of this general type has become known heretofore from U.S. Pat. No. 3,110,253 to Du Bois wherein a frictionally driven distributor roller is shown in the interior of which, a ball is received between two roller races, one of which is curved, for rolling movement therein so as to impart a longitudinal oscillating movement to the distributor roller. Due to the rolling movement of the ball, the oscillating or reciprocal displacement of the distributor roller is stepped-down or reduced in speed.

In the aforementioned heretofore known device, the roller race fastened to the fixed shaft is disposed at the inner side of a bushing-like member whereas the curved roller race revolving with the roller shell is located at the outside of a bushing. Both of these machine parts are very expensive to manufacture from a production-engineering standpoint and, consequently, quite costly. The roller races or tracks must be hardened and ground, the curved roller race, at the direction reversing locations thereof being able to be produced with the required precision only with great difficulty due to the shape of the grinding wheel. If the ball has play between the two roller races due to manufacturing inaccuracies, the danger arises that it will not be entrained by the revolving, curved roller race so that the distributor roller, in such a case, performs an uncontrolled reciprocatory or oscillatory movement.

It is, accordingly, an object of the invention to provide a device for axially reciprocating an inking-unit roller which is of relatively simple and economical construction and which will ensure reliable rolling of the ball and, therewith, highly precise movement of the inking-unit roller without any great production-engineering expense.

With the foregoing and other objects in view, there is provided, in accordance with the invention, a device for axially reciprocating an inking-unit roller of a rotary printing machine having a fixed shaft and a frictionally driven roller shell comprising a pair of rings formed with opposing circular roller tracks disposed within the inking-unit roller and respectively secured to the shaft and the roller shell, one of the rings being skewed in axial direction with respect to the other of the rings, and a ball rollably received in both of the roller tracks and actuatable for effecting a step-down in speed of the axial reciprocatory motion of the inking-unit roller.

A device of such construction for producing axial reciprocation can effect, for example, an axial displacement of the inking-unit roller of 8 mm for each 1.8 revolutions or rotations of the distributor roller. Such a distributor roller may have various applications in an inking unit or system, mainly, however, as a rider roller associated with a former or application roller in letterpress or offset printing machines. The rings which are used in the device according to the invention are commercially available conventional bearing rings, so that for a high degree of operational reliability or trouble-free operation, a very small financial expenditure is required for the device according to the invention.

In accordance with another feature of the invention, the pair of rings are a radially inner and radially outer ring, said radially outer ring being mounted axially skewed relative to the radially inner ring in an elastic bearing ring having a spherical bearing surface, and including respective spacer rings disposed at both sides of the bearing ring for guiding the bearing ring.

The elastic bearing ring affords, in a relatively simple manner, a slight prestressing or preloading of the ball between the roller track rings so as to preclude reliably any stopping or jamming thereof.

In accordance with an alternate feature of the invention, the pair of rings are a radially inner and radially outer ring, the radially inner ring being mounted axially skewed relative to the radially outer ring and engaging an entrainer flange formed with a cage-like end for accommodating therein rollers of a roller bearing, the rollers being revolvable by the frictionally driven roller shell and being rollable on an inner race mounted on the shaft for imparting a rotary drive at a stepped-down speed to the radially inner ring.

Due to the stepped-down or reduced drive speed of the radially inner ring, a further step-down or reduction in speed of about 4:1 is achieved, so that the speed of the reciprocatory movement may be stepped-down or reduced even further.

In accordance with a concomitant feature of the invention, the skewed radially inner ring is mounted on an elastic bearing ring having a spherical bearing surface, and including respective thrust bearings disposed through the intermediary of a spacer member and the entrainer flange, respectively, at both sides of the bearing ring for guiding the latter. By thus elastically supporting the radially inner ring, stopping of the ball can be avoided reliably.

Other features which are considered as characteristic for the invention are set forth in the appended claims.

Although the invention is illustrated and described herein as embodied in device for axially reciprocating an inking-unit roller of a rotary printing machine, it is nevertheless not intended to be limited to the details shown, since various modifications and structural changes may be made therein without departing from the spirit of the invention and within the scope and range of equivalents of the claims.

Figure 2:
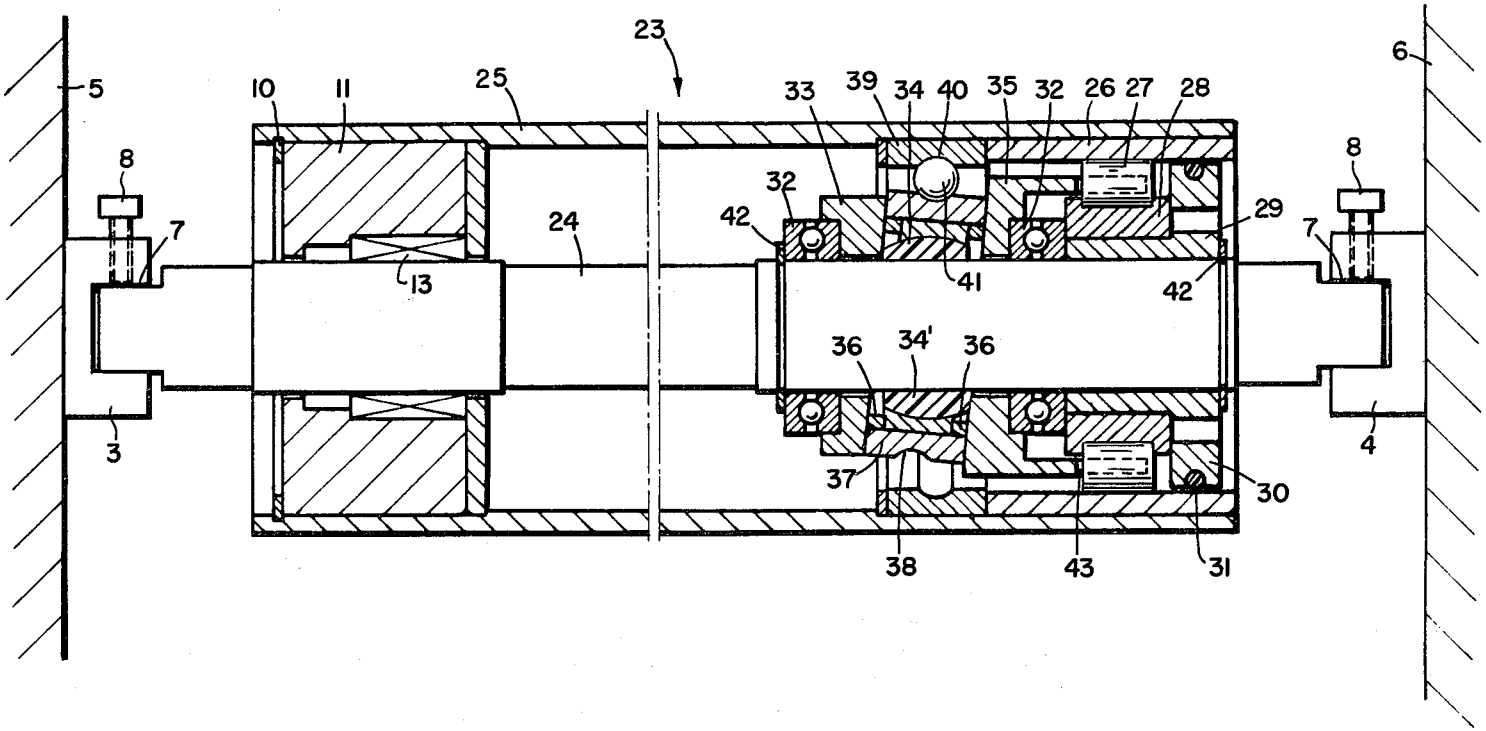

The construction and method of operation of the invention, however, together with additional objects and advantages thereof will be best understood from the following description of specific embodiments when read in connection with the accompanying drawing, in which:

FIG. 1 is a longitudinal sectional view of an inking-unit roller constructed in accordance with the invention; and FIG. 2 is a view like that of FIG. 1 of another embodiment of the invention, the inking-unit roller having a stroke imparted thereto in axial direction which is reduced in speed further than that of the roller of FIG. 1.

Referring now to the drawing and first, particularly, to FIG. 1 thereof, there is shown an inking-unit roller 1 revolvable on a shaft 2. The latter, in turn, is mounted at both ends thereof on bearings 3 and 4 between side frames 5 and 6. The shaft 2 is formed at both ends thereof with flats 7 and clamped thereat by means of respective screws 8 so that the shaft 2 cannot rotate.

The inking-unit roller 1 is formed of a roller shell 9 wherein bearing bushings 11 and 12 fastened at both ends of the roller shell 9 by clamping or expansion rings 10 are disposed, the bushings 11 and 12, in turn, accommodating respective needle bearings 13 for revolvably mounting the roller shell 9. The needle bearings 13 also permit axial movement of the inking-unit roller 1.

Within the roller shell 9, preferably near the bearing bushing 12, two spacer rings 14 and 15 are disposed, between which an elastic bearing ring 16 is provided which, in turn, accommodates, at the inner periphery thereof, a ring 17 having a circular rolling path or roller track 20. Both spacer rings 14 and 15 are of such construction that not only the elastic bearing ring 16 but also the ring 17 are mounted in a skewed or offset angular manner with respect to the roller shell 9. This results for providing the outer bearing surface 16' and the inner shell surface of the bearing ring 16 with a spherical shape.

Within the ring 17, a second ring 18 with a likewise circular rolling path or roller track 19 is provided which is mounted on the shaft 2 between the two expansion or clamping rings 21. A ball 22 rolls around between the two rolling paths or roller tracks 19 and 20 so that, when the roller shell 9 turns or revolves, axial reciprocation thereof occurs due to the skewed or axially offset inclined disposition of the rolling path or roller track 20. Because the ball 22 rolls around at a slower speed than the roller shell 9 revolves, the reciprocatory motion of the latter is stepped down to about 1.8:1. For other diameter ratios, this reduction can also be slightly different, such as 2:1, for example. The reciprocation of the inking-unit roller 1 is afforded or rendered possible due to a sidewise or lateral freedom of movement of the needle bearings 13 on the shaft 2.

The embodiment of the inking-unit roller 23 according to the invention which is shown in FIG. 2 does not differ from that of FIG. 1 with respect to the bearing supports of the shaft 24 at the side frames 5 and 6. Also, the roller shell 25 is mounted, at the left-hand side thereof, revolvably and axially displaceably on the shaft 24 by means of a bearing bushing 11 and a needle bearing 13, exactly as in FIG. 1.

The bearing support of the roller shell 25 on the right-hand side in FIG. 2 is effected via an outer bushing 26, via rollers 27 and an inner ring or race 28 which is mounted on a support bushing 29 on the shaft 24. The rollers 27 within the outer bushing 26 permit rotary movement and axial movement of the roller shell 25.

The right-hand side of the inking-unit roller 23, as shown in FIG. 2, is sealed off by a sealing ring 30 with a rubber O-ring 31.

Two thrust bearings 32 are disposed on the shaft 24 near the support bushing 29, and a spacer member 33, an elastic or cushion bearing or support 34 having a spherical bearing face 34', and an entrainer flange 35 are located between the two thrust bearings 32. The inner ring 37 having a rolling path or roller track 38 is mounted with the aid of two intermediate rings 36 on the spherical bearing surface 34' of a yieldable or elastic bearing 34 in offset or skewed and inclined relationship to an outer ring 39 mounted in the roller shell 25 and having a rolling path or roller track 40 and being disposed opposite to the inner ring 37. A ball 41 is again provided between the inner and outer rings 37 and 39 which, due to the rotary or revolving motion of the roller shell 25 produces a reciprocating motion of the latter. The embodiment of the invention illustrated in FIG. 2 differs from that of FIG. 1 in that, instead of the outer ring 17 of FIG. 1 being skewed or offset relative to the inner ring 18, it is the inner ring 37 of the embodiment of FIG. 2 which is skewed or slantingly offset axially with respect to the outer ring 39. The operation of both embodiments is exactly the same so that, also in the case of the embodiment of FIG. 2, due to the rolling motion of the ball 41, a step-down or reduction in the reciprocating movement of about 1.8:1 occurs. Two retaining rings 42 are provided to fix the bearings and the moving parts on the right-hand side of the inking-unit roller 23 of FIG. 2 on the shaft 24.

The embodiment of the invention shown in FIG. 2 differs from that of FIG. 1 also in that not only the spacer members 33 but also the inner ring 37 and the entrainer flange 35 are rotatably mounted between the two axial bearings and that the entrainer flange 35 is formed with a cage-like end 43 accommodating the rollers 27. The end 43 thus fulfills the function of a conventional roller-bearing cage which retains the individual rollers in such a manner that they can revolve and are disposed at a given spacing from one another. The effect of the aforedescribed construction is that, due to the stepped-down or reduced speed of rotation of the rollers 27, the entrainer flange 35 and, accordingly, the inner ring 37 and the spacer member 33 are driven with a reduced speed of about 2:1. Since a step-down or reduction of about 1.8:1 to 2:1 is already produced beforehand, however, due to the rotational or revolving movement of the roller 41, a total step-down or reduction of about 4:1 results, which means that the reciprocatory movement of the roller shell 25 occurs once in four revolutions of the inking-unit roller 23. Due to this further slow-down in the reciprocatory motion of the inking-unit roller, abrupt reversal of direction and consequent vibrations in the roller per se are reliably precluded. Commercially available ball-bearing rings are used for the rings 17, 18, 37 and 39 of the invention. Conventional, readily available parts are also used for the rollers 27, the inner ring 28 and the other bearing components.

There are claimed:

1. Device for axially reciprocating an inking-unit roller of a rotary printing machine having a fixed shaft and a frictionally driven roller shell mounted for rotation about the fixed shaft comprising a pair of rings formed with opposing circular roller tracks disposed within the inking-unit roller and respectively secured to the shaft and the roller shell, one of said rings being skewed in axial direction with respect to the other of said rings, and a ball rollably received in both of the roller tracks and actuatable for effecting a step-down in speed of the axial reciprocatory motion of the inking-unit roller, said pair of rings being a radially inner ring secured to the shaft and a radially outer ring, and including an elastic bearing ring having a spherical bearing surface circumferentially surrounding and engaging said radially outer ring, said radially outer ring being engaged through the intermediary of said elastic bearing ring with the roller shell and mounted axially skewed relative to said radially inner ring, and further including respective spacer rings disposed at both sides of said bearing ring and engaging the roller shell for guiding said bearing ring.

2. Device for axially reciprocating an inking-unit roller of a rotary printing machine having a fixed shaft and a frictionally driven roller shell mounted for rotation about the fixed shaft, comprising a pair of rings formed with opposing circular roller tracks disposed within the inking-unit roller and respectively secured to the shaft and the roller shell, one of said rings being skewed in axial direction with respect to the other of said rings, and a ball rollably received in both of the roller tracks and actuatable for effecting a step-down in speed of the axial reciprocatory motion of the inking-unit roller, said pair of rings being a radially outer ring secured to the roller shell, and a radially inner ring mounted on the shaft and axially skewed relative to said radially outer ring and engaging an entrainer flange formed with a cage-like end for accommodating therein rollers of a roller bearing, said rollers being revolvable by the frictionally driven roller shell and being rollable on an inner race mounted on the shaft for imparting a rotary drive at a stepped-down speed to said radially inner ring.

3. Device according to claim 2 wherein said axially skewed radially inner ring is mounted on an elastic bearing ring having a spherical bearing surface, said entrainer flange engaging said radially inner ring at one side thereof, and including a spacer member mounted on the shaft and engaging said radially inner ring at a side opposite said one side thereof, and respective thrust bearings disposed on the shaft in engagement with said spacer member and said entrainer flange, respectively, at both sides of said bearing ring for guiding said bearing ring.

4. Device for axially reciprocating an inking-unit roller of a rotary printing machine having a fixed shaft and a frictionally driven roller shell mounted for rotation about the fixed shaft comprising a pair of rings formed with opposing circular roller tracks disposed within the inking-unit roller and respectively secured to the shaft and the roller shell, and a ball rollably received in both of the roller tracks and actuatable for effecting a step-down in speed of the axial reciprocatory motion of the inking-unit roller, said pair of rings being a radially inner ring disposed on the shaft and a radially outer ring mounted skewed with respect to said radially inner ring, said radially outer ring being coaxially disposed in an elastic bearing ring having a spherical bearing surface engaging the roller shell and spacer means mounted within the roller shell at both sides of said bearing ring.

* * * * *